US009003854B2

(12) United States Patent
Guo et al.

(10) Patent No.: US 9,003,854 B2
(45) Date of Patent: Apr. 14, 2015

(54) SPLIT HOUSING CLUSTER MILL DESIGNED FOR TEMPER AND COLD ROLLING

(75) Inventors: Remn-Min Guo, Farmington, CT (US); Douglas C. George, Trumbull, CT (US); Kirk Michael Pettit, Prospect, CT (US)

(73) Assignee: I2S, LLC, Yalesville, CT (US)

( * ) Notice: Subject to any disclaimer, the term of this patent is extended or adjusted under 35 U.S.C. 154(b) by 918 days.

(21) Appl. No.: 13/162,289

(22) Filed: Jun. 16, 2011

(65) Prior Publication Data

US 2012/0318030 A1 Dec. 20, 2012

(51) Int. Cl.

*B21B 31/04* (2006.01)
*B21B 31/30* (2006.01)
*B21B 13/14* (2006.01)

(52) U.S. Cl.

CPC ..... *B21B 31/04* (2013.01); *B21B 31/30* (2013.01); *B21B 13/147* (2013.01)

(58) Field of Classification Search

CPC ..... B21B 31/04; B21B 13/147; B21B 31/00; B21B 31/02; B21B 13/14; B21B 13/00; B21B 31/30; B21B 31/22
USPC ..... 72/242.4, 241.4, 245, 248, 244, 237
See application file for complete search history.

(56) References Cited

U.S. PATENT DOCUMENTS

| | | | | |
|---|---|---|---|---|
| 3,858,424 | A | 1/1975 | Kajiwara et al. | |
| 4,237,714 | A | 12/1980 | Polukhin et al. | |
| 4,656,855 | A * | 4/1987 | Sakamaki et al. | 72/241.4 |
| 5,142,896 | A | 9/1992 | Berger et al. | |
| 5,355,707 | A | 10/1994 | Inoue et al. | |
| 5,596,899 | A | 1/1997 | Sendzimir et al. | |
| 5,666,844 | A | 9/1997 | Bieber | |
| 5,857,372 | A | 1/1999 | Sendzimir et al. | |
| 5,996,388 | A | 12/1999 | Mantovan et al. | |
| 6,725,701 | B2 | 4/2004 | Nakayama et al. | |
| 7,765,844 | B2 | 8/2010 | Guo | |
| 2009/0158802 | A1 * | 6/2009 | Guo | 72/242.4 |

* cited by examiner

*Primary Examiner* — Shelley Self
*Assistant Examiner* — Mohammad I Yusuf
(74) *Attorney, Agent, or Firm* — Mark Loen

(57) ABSTRACT

It is a primary object of the present invention to provide a pre-stressed rolling mill which has the advantages of a conventional mono-block mill housing and utilizes a standard Cluster mill gauge eccentric bearing gauge control system. It is highly desirable to have a rolling mill with a low cost mill housing design, a high mill stiffness, a simplified gauge control system, a capacity for multiple work roll ranges, and satisfactory side to side tilting. Such a mill is capable of operating satisfactorily as a commercial temper mill and a commercial cold mill.

7 Claims, 20 Drawing Sheets

SPLIT HOUSING CLUSTER MILL DESIGNED FOR TEMPER AND COLD ROLLING

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO SEQUENCE LISTING, A TABLE, OR COMPUTER PROGRAM LISTING

Not applicable.

BACKGROUND OF THE INVENTION (1) Field of the Invention

This application is directed to improvements in rolling mill housings used in rolling operations in the flat rolled metal industry. In particular, the present invention is directed toward a multi-roll cluster type of rolling mill.

(2) Description of Related Art

Cluster mills are popular in the rolling mill industry when an ultra-high strength material is rolled, a high gauge reduction is taken, a thin exit gauge is rolled, or any combination of the three. A cluster mill provides many advantages to the operation of a rolling mill and includes the following: small diameter work rolls, high housing stiffness, and a simplified gauge control. In many previous applications, the cluster mill housing has been built based on a mono block design, such as seen and described in U.S. Pat. No. 5,421,184, U.S. Pat. No. 2,187,250 in FIG. 8, and U.S. Pat. No. 2,776,586 in FIG. 8.

In particular, the gauge (or thickness) control is excellent due to the high mill stiffness where entry gauge variances tend to be smoothed out. The higher mill modulus generates smaller mill stretch, which makes stable gauge control. The higher mill stiffness does this because entry gauge spikes are met with a sharp increase in rolling force, and entry gauge drops see a deeper fall off in rolling force, especially when compared to other types of rolling mills and gauge control schemes.

The cluster mill method of gauge control is very simple and is provided by rotating bearing shafts supported within eccentric saddles, which adjust the positions of the backup rolls, which in turn adjust the work roll gap. The developed rolling force is transferred to the mono block housing through the rolls at various angles which add to the mill stiffness. The force needed to rotate the bearing shafts, i.e. to control the exit thickness or exit gauge of the metal strip, is a fraction of the actual rolling force, approximately 3-5%, which simplifies the design of the controlling equipment. The resolution of gauge control becomes much finer thanks to these mechanical advantages. The rotation of the bearing shafts is done mechanically, often by a rack and pinion arrangement, and is driven by a hydraulic system for a fast response, or alternately, is driven by an electro mechanical motor system which is usually slower. The highly leveraged movement also means that the movement of any activation means, such as a rack and pinion, uses equipment based on common commercial machined tolerances, and larger movements of the control system will cause a very fine adjustment in the roll gap.

Though a Cluster mill has historically been attractive for many rolling applications, there still remains a need for improved flexibility in the rolling operation, specific to the needs of an operating plant. In particular, the cluster mill rolling operation is not conveniently designed to operate with different work roll diameters, such as may be used with temper rolling and cold mill rolling. Temper rolling is more optimized for speed and uses larger diameter rolls with a lower rolling force. Cold rolling uses smaller diameter rolls for larger reduction and is optimized for higher rolling forces at reduced speeds. It is advantageous for some plant operations to be able to operate a cold mill, anneal the material, and then operate a temper mill to provide flatness and final material properties. For a low production operation, it is undesirable to purchase redundant cold mills that will not be used all the time. Other advantages of multiple diameter rolling mill operation are readily apparent to a plant operator.

One disadvantage to using a Cluster mill is the rolling force being applied during a strip break. In many cases, a strip break results in many pieces of metal strip remaining within the mono block, and pieces of the metal are likely to wrap around various rolls in the cluster roll arrangement. This is a common, though infrequent, event during the rolling operation. It is helpful to be able to open up a mill, i.e. create a large opening gap between the work rolls, fairly easily and reasonably quickly to clear the unwanted metal out of the mill housing area. This opening can be created off line, when the mill is not in a rolling mode.

During a strip break or loss of tension, it is not necessary in all cases to provide an actual work roll gap opening. In fact, a roll gap opening is disliked by some operators due to the problems associated with keeping small diameter work rolls inside the mill. The rolls are likely to spill out of the mill in the event of a strip break (i.e. 'mill wreck') due to the uncontrolled high forces.

In addition, the mono-block Cluster mill has a limited range of work roll diameters that will operate within the design of the mono block. The rotating bearing shafts often allow a very narrow operating range, on the order of 0.10" at the work roll gap.

Another disadvantage of the Cluster mill is the reduced ability to be flexible for a varied rolling operation. It is highly desirable in some commercial settings to have a single rolling mill capable of cold rolling with a heavy reduction and temper rolling with a light reduction. A temper rolling configuration preferably utilizes a larger work roll size. Larger work rolls allow for a longer work roll life, a faster rolling operation, favorable strip shape, and better rolling feasibility. In contrast, the mono block Cluster mill is unattractive for a mill that is capable of both temper and cold rolling operations.

The mono block is not designed for a convenient and accurate tilting arrangement when there is a significant side to side gauge variance in the metal strip, that is, a wedge shaped strip. Depending upon the upstream hot rolling operation, a metal strip will often have a moderate thickening in the middle of 1 to 3% of the nominal gauge normally, even 5% for some cases. After hot rolling, the strip is sometimes slit into two halves (or more) for further downstream processing which includes rolling on a Cluster mill. This presents a wedge shaped strip to the Cluster mill with an unpredictable thickness across the width. Since the cluster mill design does not include a rolling force measurement, it is difficult to make an accurate side to side rolling gap correction. The rotation of the crown eccentric rings used for profile control often do not provide enough tilting capability, when considering that the operating range may be reduced due to a particular work roll diameter pair in the mill. Consequently, rolling a wedge shaped strip will have problems which include strip breakage, creating camber, creating centerbuckle, creating uneven edge wave, and other unusual strip flatness problems. Improved flexibility is highly desirable.

It is desirable to maintain the amount of mill stiffness by avoiding issues with precision maintenance of high pressures in hydraulic cylinders during the rolling operation.

U.S. Pat. No. 5,142,896 describes a pre-stressed cluster rolling mill using a dual action upper cylinder to create the prestress between the upper and lower mill housings. Though there are certain advantages in operation, the double acting cylinder requires a highly responsive hydraulic control system to overcome the softer mill modulus due to the oil column involved in creating the rolling force. The mill modulus is reduced due to the movement of the top housing and the mechanical advantage is lost due to not using the eccentricity of bearings on rolls B and C and the rack-pinion mechanism for gauge control. This type of rolling mill lacks simplicity for certain markets where low maintenance and minimalistic control that yields high gauge accuracy are greatly preferred. In particular, low production markets desire simplicity in operation and maintenance.

U.S. Pat. No. 6,260,397 considers the need to provide operational improvements that are not available with a mono block. The design does not take advantage of the mono block stiffness, but conceptually splits the mono-block, turning it into a pair of chocks that hold the cluster rolls. The design does not use the simplified gauge control available with a mono block, and is not a prestress design. The design has a relatively low mill stiffness and uses a typical rolling mill gauge control system, such as is seen in a four high or six high mill.

U.S. Pat. No. 5,596,899 by Sendzimir, et al, mentions a prestress mill in the prior art discussion of FIG. 2 and then discusses an improved design in FIG. 4. There are improvements in convenience with respect to mill opening, however the prestress is maintained by a hydraulic cylinder with the subsequent loss of mill housing stiffness. This can be compensated by a suitable highly responsive hydraulic design, however, in some cases it is a less desirable method of providing the high mill modulus. It is preferable to provide simplicity in design implementation, and avoid control interaction to improve overall reliability by eliminating complicated control schemes which operate simultaneously.

U.S. Pat. No. 5,996,388 describes hydraulically preloaded rolling stands utilizing hydraulic prestress rods and hydraulic opening rods. Though a pre-stressed mill is shown, as a practical matter, the design is overly complicated and expensive, and does not take an optimal approach to solving operational issues. The design includes numerous large diameter machined shafts which impact and increase the mill housing design and size. The design is unsuitable for an operation which seeks a low cost and simplified approach to rolling to close tolerances.

There is a need to provide an improved design with a high rolling mill stiffness, a simplified gauge control system, a large work roll gap opening for threading, a method to reduce the work roll force during a strip break, satisfactory side to side tilting during rolling, and is able to use the work rolls over a much wider diameter range. Such a mill is capable of operating satisfactorily as a commercial temper mill and a commercial cold mill in a highly flexible, low cost, and low production environment.

BRIEF SUMMARY OF THE INVENTION

It is a primary object of the present invention to provide a pre-stressed rolling mill which has the advantages of a conventional mono-block mill housing, utilizing a Cluster mill gauge control system, and overcomes limitations and operational problems just described. It is desirable to have a rolling mill with a high mill stiffness, a simplified gauge control system, a simplified tilting method for poorly formed materials, and is able to use work rolls over a much wider diameter range. Such a mill is capable of operating satisfactorily as a commercial temper mill and a commercial cold mill.

BRIEF DESCRIPTION OF THE SEVERAL VIEWS OF THE DRAWING(S)

Figure 9B:
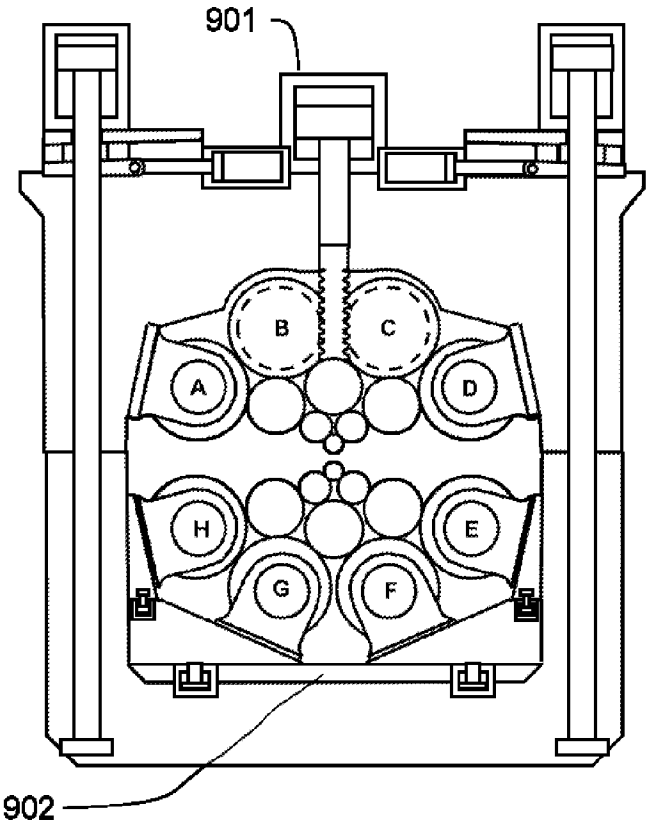
Figure 9A:
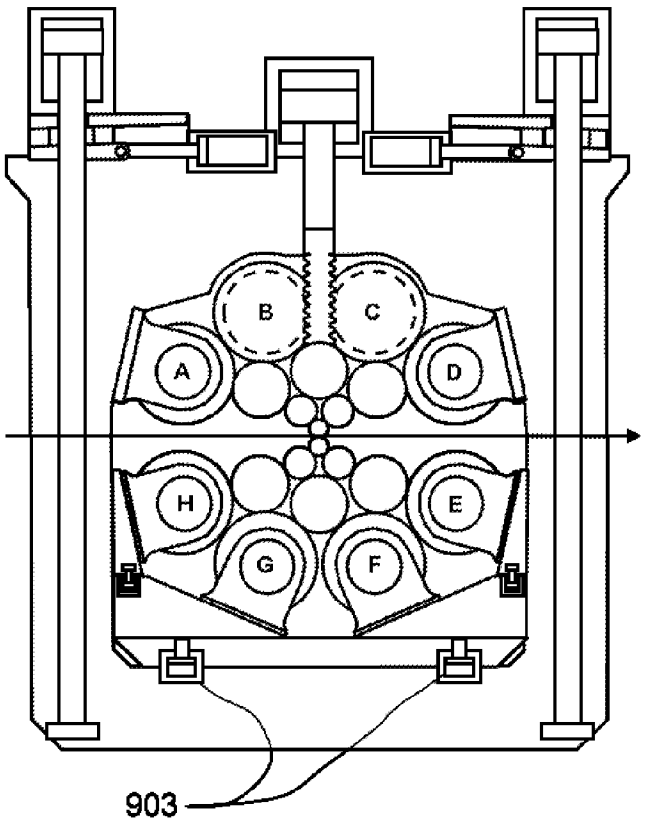
Figure 10:
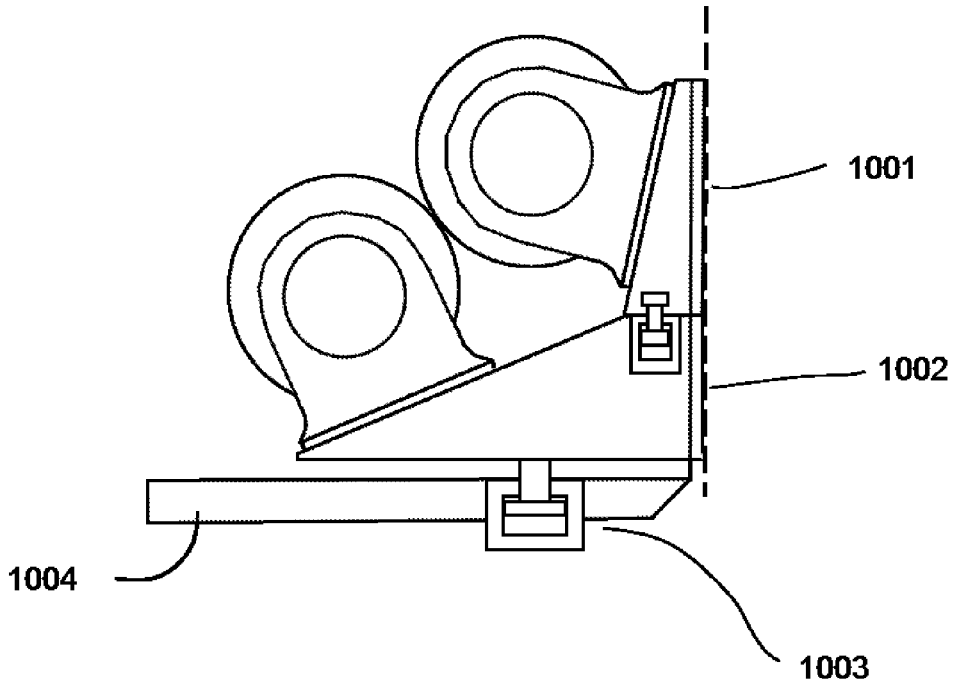

FIGS. 9A-9B, and 10 illustrate additional details on the lower passline adjustment.

Figure 11A:
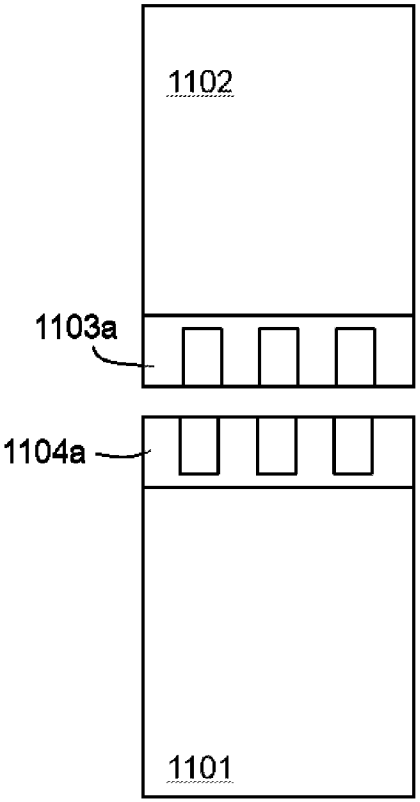
Figure 11B:
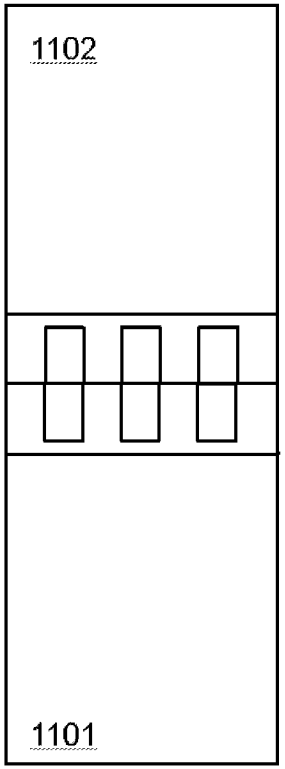
Figure 11C:
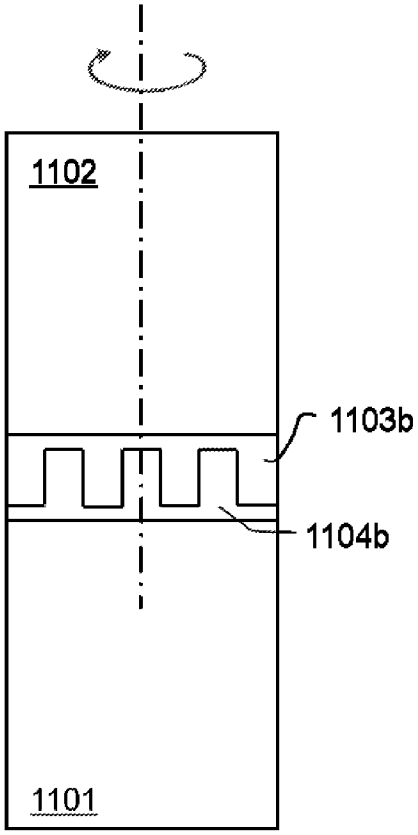

FIGS. 11A-11C illustrates an example of a simplified housing spacer design.

FIGS. 12A-I show the sequence of steps to switch the mill stand from small to large diameter work rolls.

DETAILED DESCRIPTION OF THE INVENTION

The present invention utilizes the existing method of controlling the gauge at the exit of the cluster mill by rotating eccentric bearings around roll bearing shafts which are mounted within eccentric saddles. This method is widely accepted commercially and is very preferable for commercial reasons. To that end, adding additional features and improvements preferably utilize a highly stiff mill to incorporate the existing gauge control method. U.S. Pat. No. 5,471,859 "Background Art" describes the use of eccentric rings or shafts on supporting roll bearings which are adjusted by a shaft and gearing system on either side of the rolling mill. The "Background Art" of U.S. Pat. No. 5,471,859 is incorporated by reference herein. The gauge control system where the exit gauge is substantially controlled by rotating at least one eccentric support roll bearing is herein called "eccentric bearing." And herein the "back up roll" or "roll" does exclusively include the backing bearings with the bearing shaft of that particular roll.

For the purposes of this application, the side of the mill where the operator generally controls the mill will be called the "operator side" or "front side." The opposite side is called the "drive side" or the "back side." The two sides are divided by the longitudinal direction of the metal strip. The rolls used for the rolling operation are nearly always inserted into the mill housings from the operator side.

The advantages of the design will be readily apparent from the figures and the associated description. In particular, the housing design is simplified by virtue of the fact that a normal cluster mill mono block housing design is used, and it is horizontally split into two. It is relatively easy to fabricate, using existing casting techniques and molding methods. Though a twenty roll cluster mill is illustrated and described in detail, other roll count cluster mills could equally be used such as twelve, and six roll designs.

Figure 1:
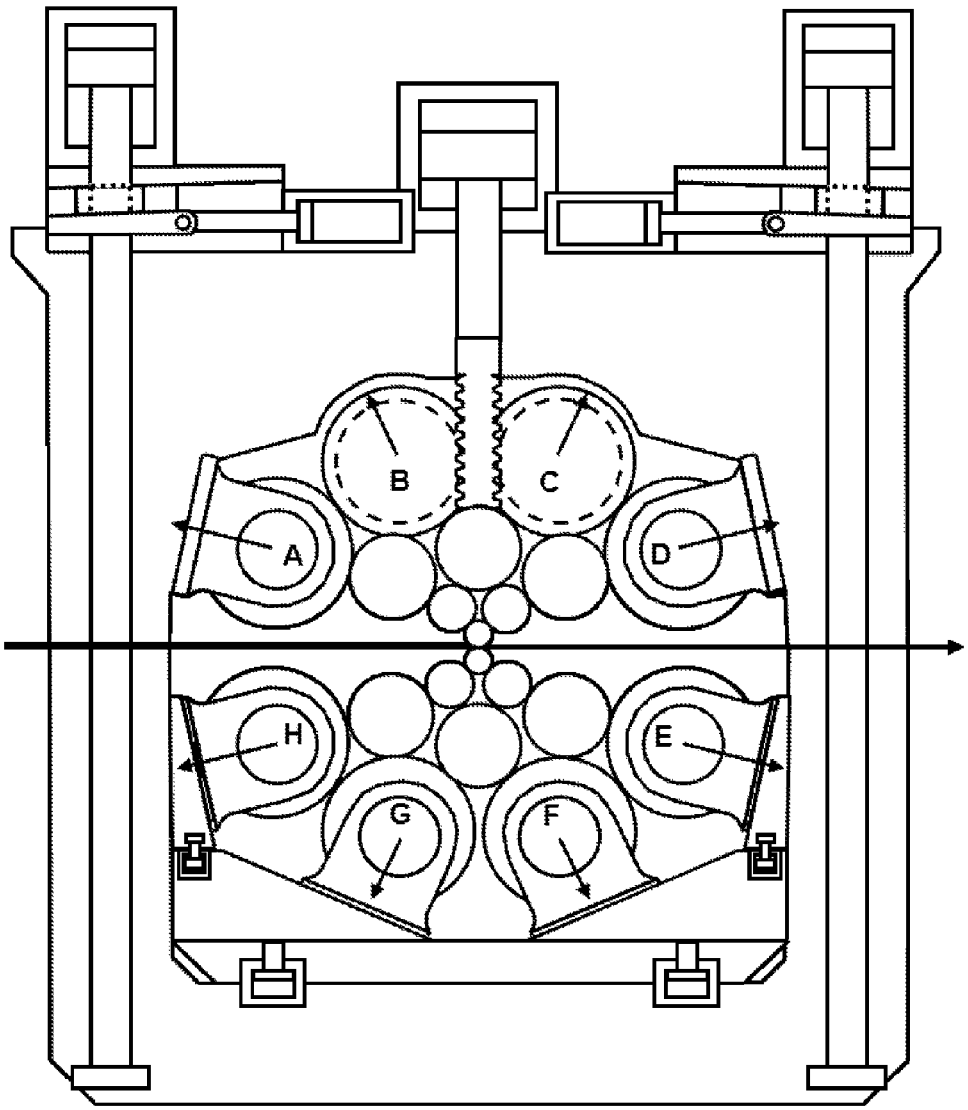
FIG. 1 is a basic prestressed cluster mill layout with small work rolls.

FIG. 1 is an operator side of a basic twenty roll cluster layout with small work rolls. Rolls A, B, C, D, E, F, G, and H are backup rolls and are segmented. Rolls B and C are used to provide exit gauge control. The design includes crown control for the roll design by incorporating power crown cylinders that incorporate push/pull cylinders. The power crown cylinders adjust rolls E and H.

The existing design does not use eccentric bearings on rolls A, D, E, F, G, and H. Only the B and C rolls in the upper cluster are used to vary the work roll gap using eccentric bearings, which greatly simplifies the operation of the mill. In a preferred embodiment, a hydraulic cylinder with a rapid response, such as a servo solenoid is used to provide quick gauge control response. Such a system, in combination with the high mill modulus, will provide excellent exit gauge control with smaller cylinder force and finer gauge resolution.

Mill tilting is provided by the upper wedges, also called rod wedges, which are available to be inserted to re-adjust the mill and bring the mill tilting back into range. The tilting amount depends on the incoming strip wedge, normally, about +/−15 thousands of an inch.

The design also allows for the bearing shaft center of rolls ADEH to be changed such that the force deviation acting on the rolls ADEH is minimized. Doing this will substantially improve the bearing life. The center dimension is calculated by a math model considering various roll configurations.

The design allows for the force vectors to converge into the housing. The design of the switchover between the larger work rolls to the smaller rolls avoids un-necessary torsion or forces on bearing mounts. This is done by determining the angles of the mounting wedges in the mill and providing for the proper support angle.

The bottom mill passline adjustment is simplified and provides for suitable step change in work roll diameter range change.

The mill modulus is designed around a solid stiffness with all solid metal parts without an oil column or softening of the mill modulus. Nor is there any worry about an oil leak causing problems for a rolling operation.

Figure 2:
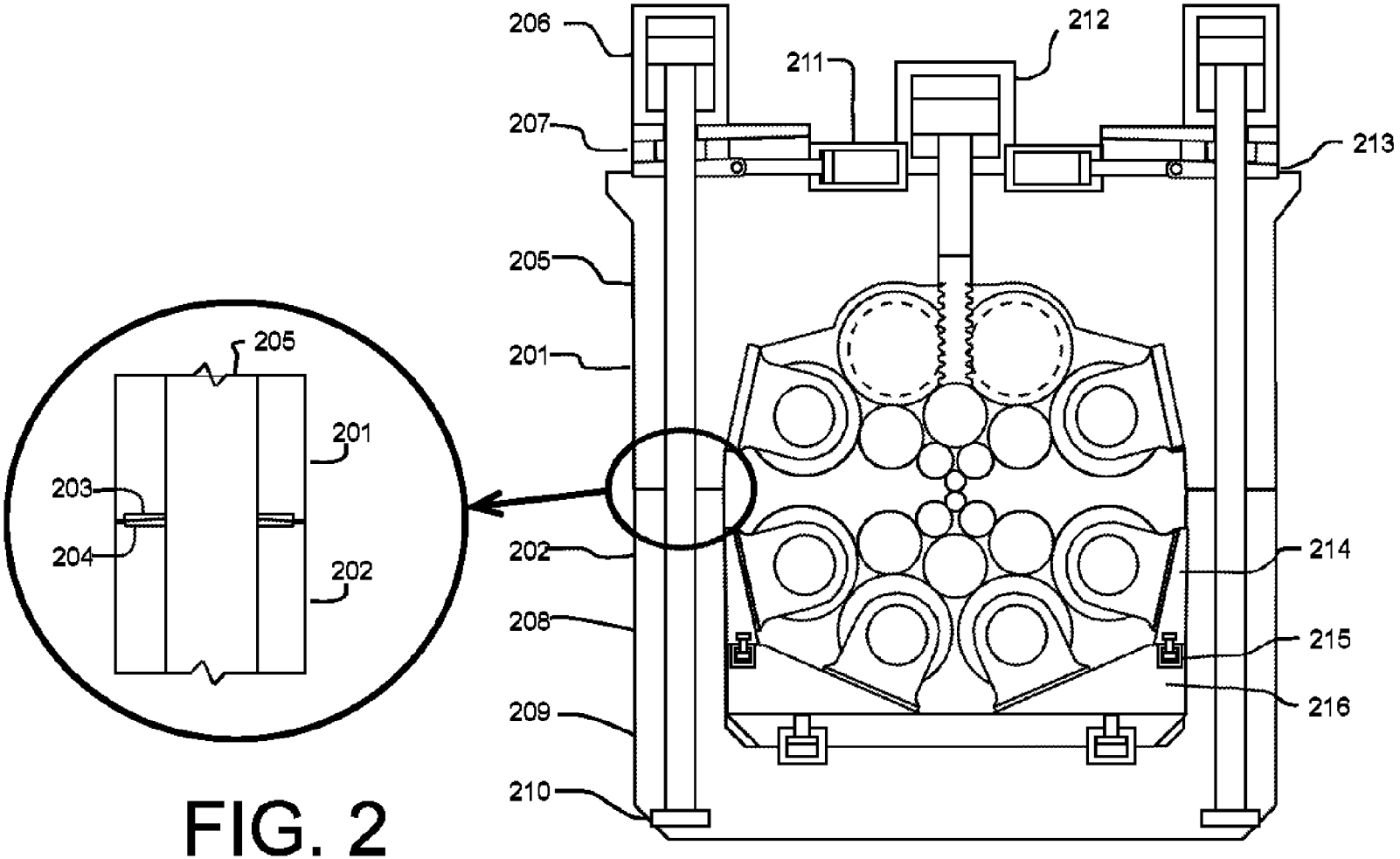
FIG. 2 shows details of the basic prestressed cluster rolling mill layout including a housing spacer insert.

FIG. 2 shows a basic layout of an embodiment of the present invention.

TABLE 1

| No. | Item | Quantity |
|---|---|---|
| 201 | Top Housing | 1 |
| 202 | Bottom Housing | 1 |
| 203 | Top spacer plate - rocking plate style preferred design | varies |
| 204 | Bottom spacer plate - rocking plate style preferred design | varies |
| 205 | Tie Rod or Pre-stress Rod | 4 |
| 206 | Pre-Stress Cylinders | 4 |
| 207 | Wedge Stand Assemblies | 4 |
| 208 | Passline Wedge Plate | 1 |
| 209 | Passline Cylinder | ≥4 |
| 210 | Tie Rod End Block | 4 |
| 211 | Wedge Cylinder | 4 |
| 212 | Automatic Gauge Control (AGC) Cylinder | 2 |
| 213 | Wedge with Sliding Grooves | 4 |
| 214 | Backup Roll Saddles | varies |
| 215 | Power Crown Cylinders | varies |
| 216 | Bottom Backup Roll Platform | 2 |

The upper housing 201 slides vertically on the tie rods 205, which are also called prestress rods. The lower housing 202 is rigidly bolted to the tie rods 205 by a tie rod end block 210, or similar rigid mechanical attaching method such as bolting, pin, tolerance fitting, or welding. The upper and lower housings are horizontally split, as illustrated, so they move relative to each other on the tie rods 205, and are controlled so that they slide in a manner so that they do not become jammed by tipping.

The location of the pre-stress cylinders is alternately at the bottom of the pre-stress rod, and the upper housing is then rigidly attached to the pre-stress rod. The lower housing is then fixed relative to the operator, and the pre-stress rod slides within it. This method of operation is somewhat less desirable as it locates the pre-stress cylinders below the operator in a place which is typically harder to maintain. However, in some situations, such as a room with crowded or low overhead space availability, it is potentially a preferred design. The same design alternative is possible for the rod wedge system, which may be installed at the top or bottom of the pre-stress rod.

The location of the tie rods is substantially symmetrical around the rolling force inside the mill housings. The locations are defined by symmetry with respect to the rolling force generated during the rolling operation, i.e. the work roll contact with the strip when it is centered in the mill. The tie rods are on the operator side and drive side, and then spaced on the entry and exit side of the work roll contact with the strip. Symmetric variances on different sides are allowable, as the motors that drive the mill may necessitate one side of the mill being spread further apart than the other. However, in the case of cluster mills, the normal design case would cause the tie rods to be substantially placed in a rectangular arrangement or an isosceles trapezoid surrounding the rolling force in the center when viewed from above. Other situations may arise based on particular design issues.

At the top of the mill, a wedge stand assembly 207 is used in connection with a hydraulic prestress cylinder 206 attached to the prestress rod to create the needed tensile stress in the prestress rod 205. Hydraulic pressure enters the rod side of the hydraulic pre-stress cylinder 206 and creates a tensile stress in the prestress rod 205. A hydraulic wedge cylinder 211 used to insert an upper wedge 213 (and an optional spacer block 217) into an opening in the prestress rod 205 to lock the prestress rod, upper housing, and lower housing together under a tensile load. Once the wedge is in place, the hydraulic pressure in the pre-stress cylinder 206 will be decreased so as to pass the pre-stress load to the wedge. The wedge system allows the pre-stress load to be maintained during rolling without the need for the upper hydraulic prestress cylinders 206 to be under pressure. The upper wedge 213 incorporates guiding slots, rails, or sliding grooves to ensure that the wedges smoothly engage the prestress rod. In one embodiment, the upper wedge 213 is a step wedge designed similar to the bottom wedge plate 208. The tensile load is high enough to create and maintain a compression stress in both the upper and lower housings during the rolling operation.

In one embodiment, the pre-stress load is set high enough so that the combined pre-stress load in all the prestress rods is 50% higher than the maximum anticipated rolling force in a rolling campaign of multiple products. Also it is preferable to set the pre-stress load high enough so that the wedges will remain in place for a rolling campaign.

Beneath the lower cluster rolls, a passline wedge plate 208 and a passline cylinder 209 are used together to provide vertical adjustment to the position of the lower cluster rolls so that the work rolls are at the proper passline position when the work roll diameter range is changed. Often the work roll diameter is changed from one design range to another, such as from a temper rolling to a cold work rolling, that is from a small gauge reduction to a large gauge reduction. In this case the work roll diameter change is typically well known and established, and the passline wedge plate 208 will only have two positions, i.e. stair step style, with a suitable slot for the lifting passline cylinders 209. The passline cylinders 209 are only used for lifting the lower roll assembly, and are then retracted and not engaged during rolling so as to not lower the mill modulus.

Because the design is intended for work rolls with different diameters, i.e. two (or more) work roll diameters, the design establishes the distance between the upper and lower mill housings by use of a spacer plate between the two housings. A single thick spacer plate is a possible design which fits around the tie rod 205. Alternately, multiple plates are used such as a top spacer plate 203—designed in rocking plate style so that the upper housing is allowed some freedom of movement with respect to the plate. A bottom spacer plate 204 also uses a preferred design of a rocking plate style to allow some freedom of movement of the lower housing with respect to the spacer plate. This prevents minor friction effects from causing problems with the upper housing movement. Another design is presented in FIG. 11.

An automatic gauge control (AGC) cylinder 212 is used to provide gauge control by rotating the backup roll eccentrics of the middle two rolls in the upper cluster assembly (i.e. rolls B and C) through a rack and pinion system. In one embodiment, the cylinder is activated via a hydraulic control system. Alternately, a standard motorized actuator is used rather than a hydraulic cylinder. The gauge control uses an exit gauge feedback measuring system, or it is set manually based on a micrometer measurement of the exit product by the operator. In some cases, such as a narrow rolling mill that is operated infrequently, simplified controls and operational methods are greatly preferred.

An improved window design for the lower cluster rolls includes improved crown control supports for the backup roll supports of rolls E and H. The segmented rolls are supported by backup roll saddles 214 which move vertically on the lower housing by sliding grooves. The number varies based primarily on the width of the strip being rolled and the width of the saddles themselves. A push/pull style power crown cylinder 215 is used to provide bi-directional shape control and crown control during rolling. A new Backup Roll Bottom Platform 216 is designed with a suitable angle to ensure the resolved force from the rolling operation is substantially perpendicular to the supporting surface. This ensures that the rolling force is dispersed onto the lower passline wedge and into the lower housing in vertical and horizontal directions.

Figure 3:
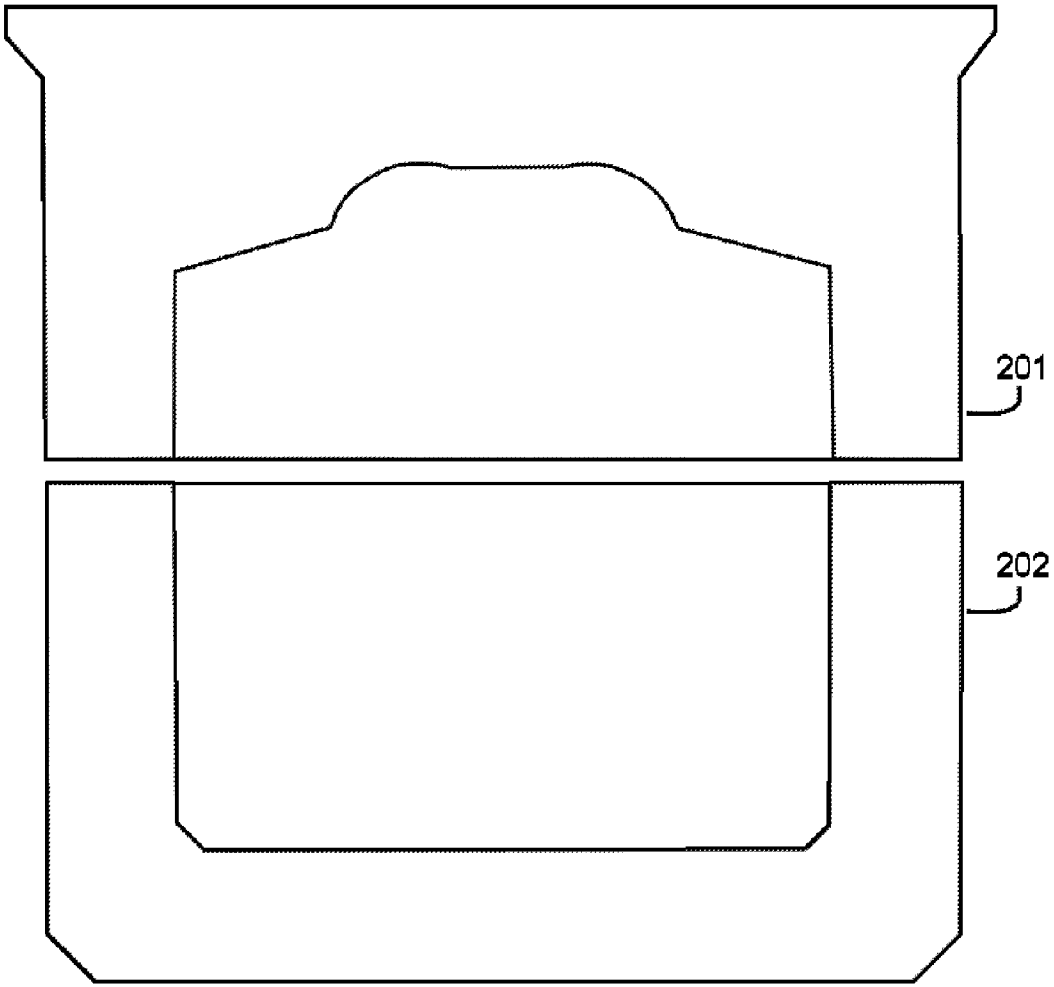
FIG. 3 illustrates top and bottom housings.

FIG. 3 shows only the upper housing 201 and the lower housing 202 without the rolls or any associated equipment.

Figure 4:
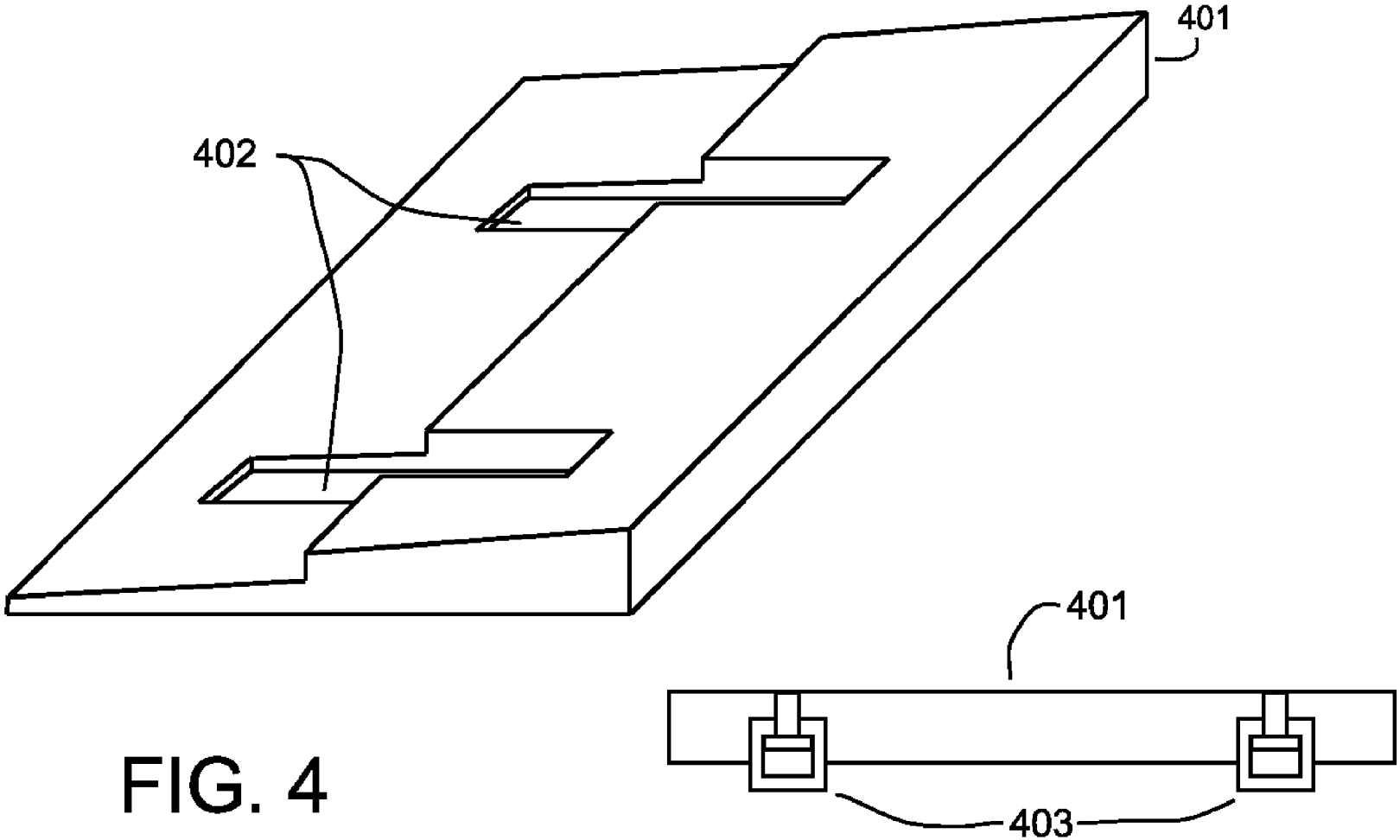
FIG. 4 shows important details of the passline adjustment system.

FIG. 4 illustrates details of the lower passline step wedge plate 401 with slots 402 for the lifting passline cylinders 403. The slots 402 allow the passline cylinders 403 to lift the lower cluster roll assembly off the passline step wedge plate 401 so it can move horizontally. The passline wedge plate will rest on the lower housing after it is inserted underneath the lower cluster roll supports. It will slide horizontally (not shown) by an actuator of choice for the designer, and may be moved using compressed air, hydraulic, electromechanical, or an electric motor. Since there are small slopes on both stages, the bottom wedge can be adjusted slightly during rolling if necessary.

Figure 5:
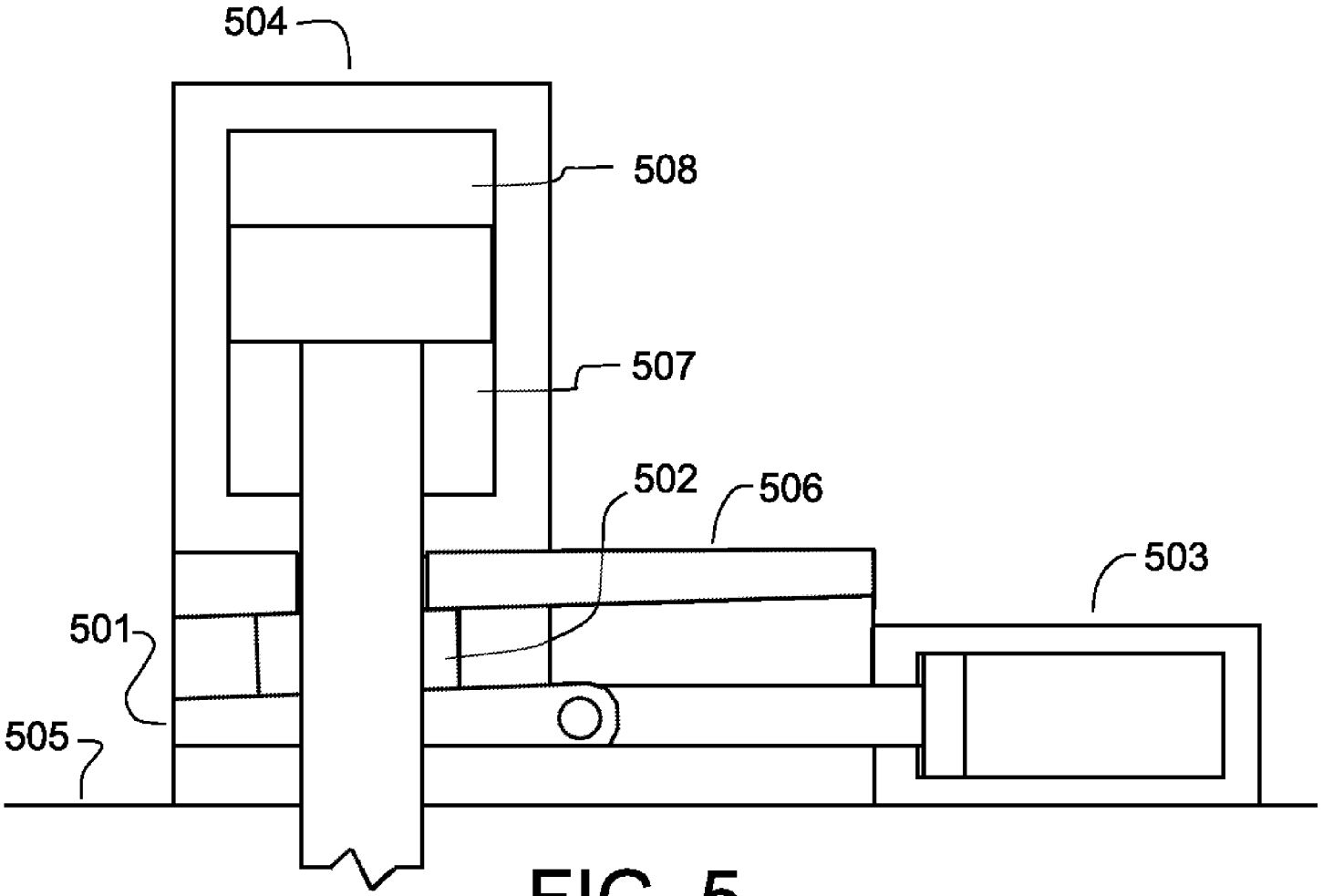
FIG. 5 shows important details of the top mill wedge system.

FIG. 5 illustrates the upper wedge system which mechanically locks the tie rod or prestress rod so that the upper and lower mill housings are pre-stressed without the need for a continuous hydraulic pressure. A low angle upper wedge 501, with an angle of 3 degrees or less, preferably 1.5 degrees on the upper surface, has a width less than the diameter of the tie rod so it is able to be inserted into the vertical tie rod. The wedge assembly rests on top of the upper mill housing 505 as illustrated, and the upper wedge 501 is activated in and out by an upper wedge cylinder 503. A machined guide block assembly 506, with grooves or slotted guides, is used to provide control for the upper wedge motion to positively guide it in and out of the tie rod. A filler block, or spacer block 502, is also inserted into the vertical tie rod as needed based on the work roll diameters in the mill cluster to correctly establish the passline and be dimensionally correct between the upper and lower housings.

The filler block takes care of dimensional problems so that the variety of work roll diameters will work with a low angle wedge. This also allows a wedge system to provide for mill tilting under load if the hydraulic wedge shifting cylinder is large enough, or based on flexibility in mill set up where the wedge can be pre-positioned for rolling to make up minor work roll gap issues. In the latter case, mill tilting is provided under load by adjusting the top wedge position independently on the drive and operator sides. In either case, the upper wedge system improves the capability of mill tilting.

The upper prestress hydraulic cylinder 504 has two chambers. A piston side 508 and a rod side 507. When hydraulic fluid pressure is on the piston side, the upper roll housing lifts away from the lower housing. When high pressure is on the rod side, the pre-stress rod is loaded with force to prestress the tie rods and the mill housings together. The wedge can then be inserted and the pressure relieved as further illustrated in FIG. 6.

Figure 6A:
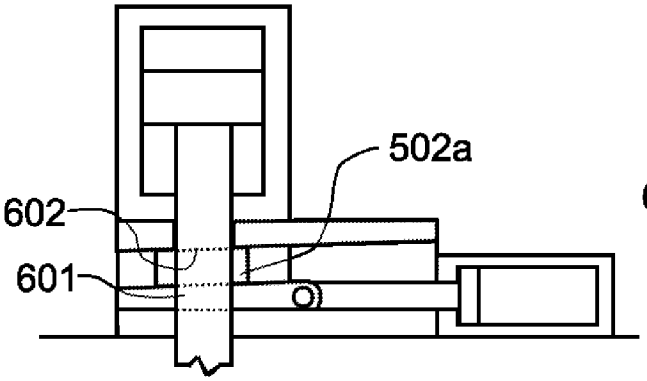
FIGS. 6A-6D show additional details of the top mill wedge system.
Figure 6B:
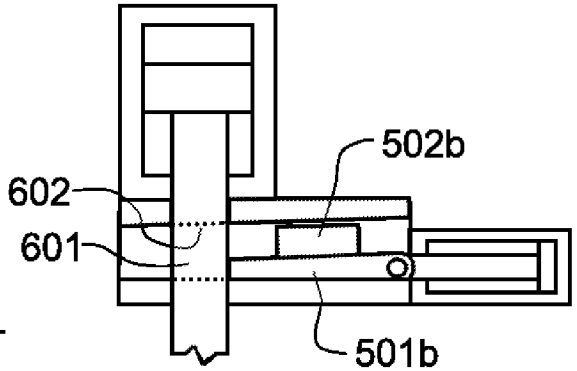
Figure 6C:
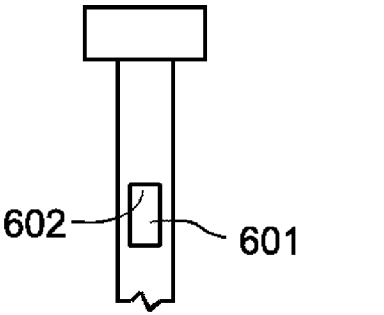
Figure 6D:
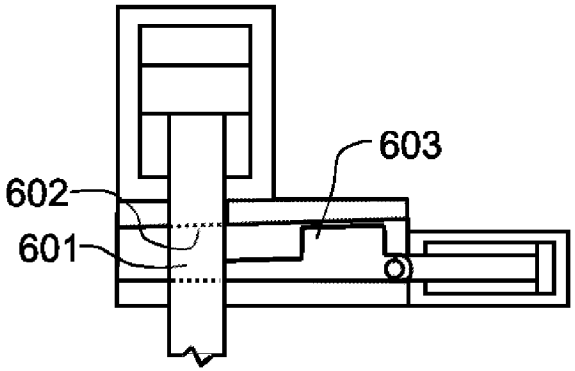

FIGS. 6A-6D illustrate how the tie rod is designed to allow prestress loading without the use of continuous hydraulic force. As seen in FIG. 6C the tie rod is machined with a cut out 601 and an upper load bearing surface 602 that allows mill rocking. The upper load bearing surface 602 is slightly curved and hardened. Alternately, a bolt in wear plate is installed for the load bearing surface. In FIG. 6A the filler block 502*a* is used to wedge tightly into the tie rod and contacts the load bearing surface 602. FIG. 6A shows the mill in rolling mode for a small diameter work roll pair. In FIG. 6B, the wedge and filler block 502*b* are withdrawn and the mill is in the process of undergoing a roll change. FIG. 6D shows an alternate design for the wedge system where a step wedge 603 is used. This design avoids certain issues with the filler block as it allows better shifting under load during the rolling operation. Alternately, the filler block 502*b* is bolted down onto the wedge 501*b* to make it equivalent to a machined step wedge 603.

Figure 7:
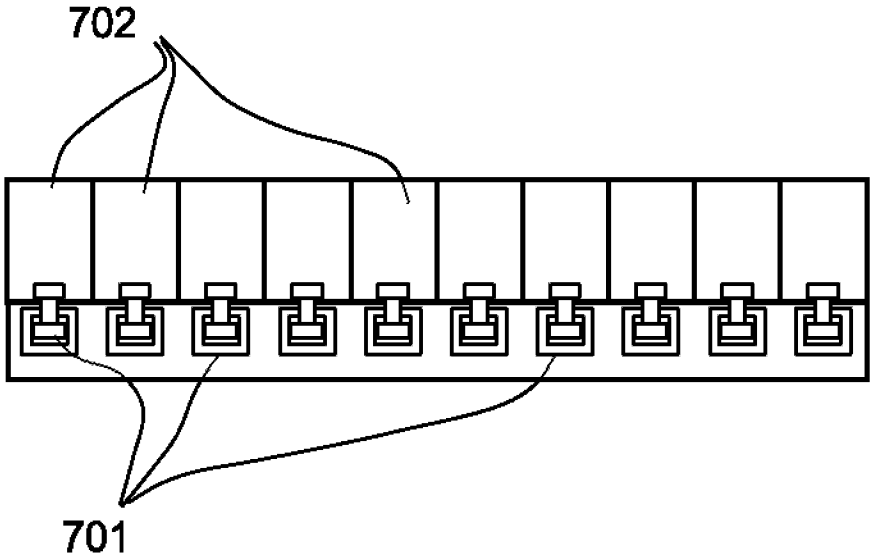
FIG. 7 illustrates the power crown cylinders that are used in shape control.

FIG. 7 shows a profile view of the power crown cylinders and the array of wedge blocks used to push the bearing supports up and down. During the passline setup, all cylinders are put into their 'lock' position. That is, a standard calibration position.

TABLE 2

| Power Crown Cylinders | |
|---|---|
| 701 | Array of Cylinder for Power Crown Control |
| 702 | Array of Wedge Blocks to Push Bearing Support |

Figures 8A, 8B:
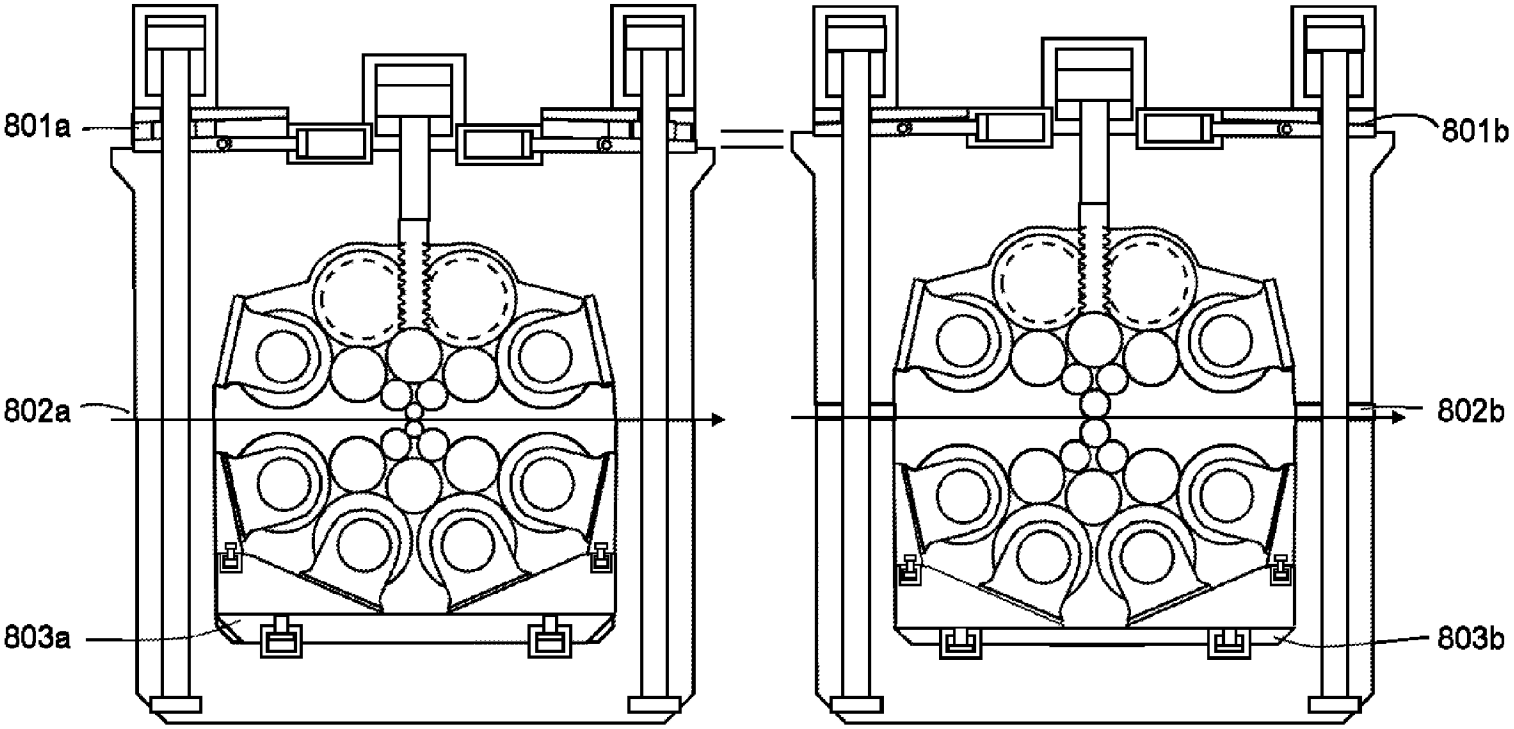
FIGS. 8A-8B illustrate how the mill wedges, housing spacer, and lower passline wedge are used to maintain passline in the mill.

FIGS. 8A and 8B illustrate how the split housing is configured for each set up of work rolls per the Table 3 below:

TABLE 3

| FIG. 8A (Small Work Rolls) | | FIG. 8B (Large Work Rolls) | |
|---|---|---|---|
| 801a | Filler Block In | 801b | Filler Block Out |
| 802a | Housing Spacer Out | 802b | Housing Spacer In |
| 803a | Bottom Wedge High | 803b | Bottom Wedge Low |

In FIGS. 8A and 8B, the rolling mill is shown in the configuration suitable for actual rolling. The work rolls are closed and the work piece is in the mill bite between the two work rolls. The upper prestress cylinders are not filled with any significant hydraulic pressure, and the upper wedges are inserted into the prestress rods to provide a mechanical lock of force between the upper and lower mill housings. The filler block, housing spacer, and bottom wedge are used to provide for a substantially constant passline position, FIGS. 9A-9B illustrate the start of a change over to a larger work roll diameter. In FIG. 9A, the mill is rolling a work piece with smaller diameter work rolls. To switch over to a larger pair of work rolls, the AGC cylinder 901 is activated to rotate the eccentric bearings of rolls B and C, and the work roll gap is opened to the extent possible. Then the backup roll cluster is lifted by wedge cylinders 903, and the lower passline wedge plate 902 is shifted to a new position. The sequence of a changeover is further described in FIGS. 12A-12I.

FIG. 10 illustrates additional details on the lower passline adjustment. The cluster mill design includes bottom vertical grooves 1001, 1002 on the lower cluster. The grooves for the power crown are extensions of the grooves for the passline adjustment platform on the edges. Below the rolls underneath the passline, a passline wedge platform 1004, or step wedge plate, is used to establish the correct passline for the work roll diameter pair being used. The passline cylinders 1003 are only used for lifting the lower roll assembly, and are then retracted and not engaged during rolling so as to not lower the mill modulus. Alternately, instead of grooves, other types of guides could be used such as rails.

TABLE 4

| | |
|---|---|
| 1001 | Groove for Power Crown Wedge |
| 1002 | Groove for Passline Adjustment Platform |
| 1003 | Cylinder to Lift Bottom Assembly |
| 1004 | Bottom Passline Step Wedge Plate |

The cylinders lift the bottom assemblies across the width of the backup roll. This causes a change in shape of the roll, i.e. the crown of the backup roll, which in turn, changes the shape of the work rolls. This adjusts the crown of the work rolls which changes the shape of the strip during the rolling operation. In a preferred embodiment, the cylinders use bi-directional control action, which provides better control. The grooves for the power crown wedge 1001 and the bottom passline wedge plate are preferably vertical.

FIGS. 11A-11C illustrates a simplified housing spacer design. The upper housing 1102 and the lower housing 1101 are illustrated as a vertical post, with an insert upper spacer 1103 and lower spacer 1104. At the far left, (FIG. 11A) the upper and lower spacers are rotated so that the teeth of the spacers are aligned as shown. When the housings are pre-stressed together, the two housings then press the upper and lower spacers together as in FIG. 11B, and the spacers are designed to carry the pre-stress load and maintain the overall mill modulus design. In FIG. 11C, the spacers are rotated relative to each other, and engage so that the distance between the upper and lower mill housings is smaller. The spacers are exaggerated in thickness for illustrative purposes. Typically, the spacers are relatively thin, only as thick as required to make up the difference in the work roll diameters and any other minor practical issue such as roll wear or a tolerance fit.

FIGS. 11A-11C illustrate one embodiment of the invention. Other spacer plate designs could equally be used, such as a uniform plate thickness. However, the design shown has advantages in being relatively permanent in the mill without the need for lifting on the part of the operator. The rotation is easily done by hand, or by an automated rotating system using electronics, compressed air, or hydraulics.

FIGS. 12A-12I illustrate the method of changing from small work rolls to larger work rolls.

TABLE 5

| | |
|---|---|
| 1201 | Prestress Cyl Rod Side |
| 1202 | PreStress Cyl. Piston Side |
| 1203 | Upper Wedge Cylinder (Rod Wedge Cylinder) |
| 1204 | Upper Wedge (Rod Wedge) |
| 1205 | Wedge Filler Block |
| 1206 | Housing Spacer Stool |
| 1207 | Housing Spacer Plate |
| 1208 | Tie Rod Load Bearing Surface |
| 1209 | Large Diameter Work Roll |
| 1210 | Passline Wedge Plate |

Figure 12A:
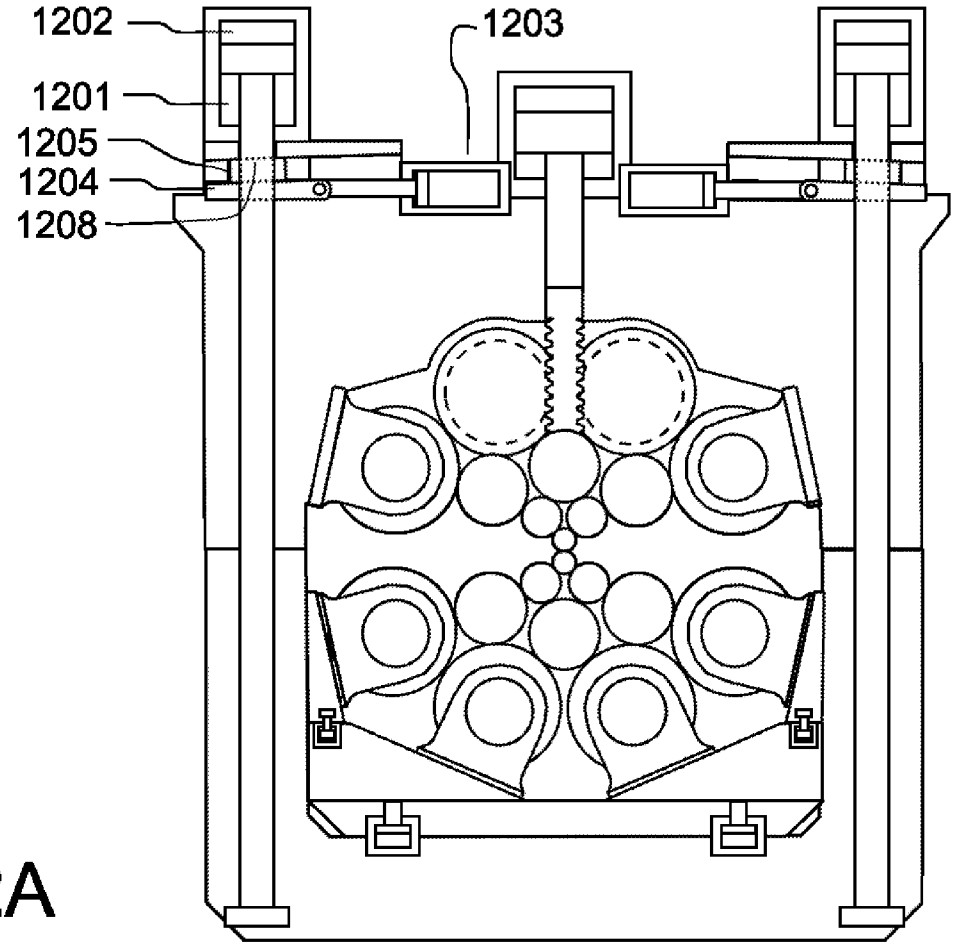

In FIG. 12A:

Mill housings are Pre-Stressed, Small Work Rolls in use

Pre-stress state load carried by Upper Wedges

Tie Rod is stretched under load

Pre-Stress Cylinder, Rod Side Pressure 1201 is low

Figure 12B:
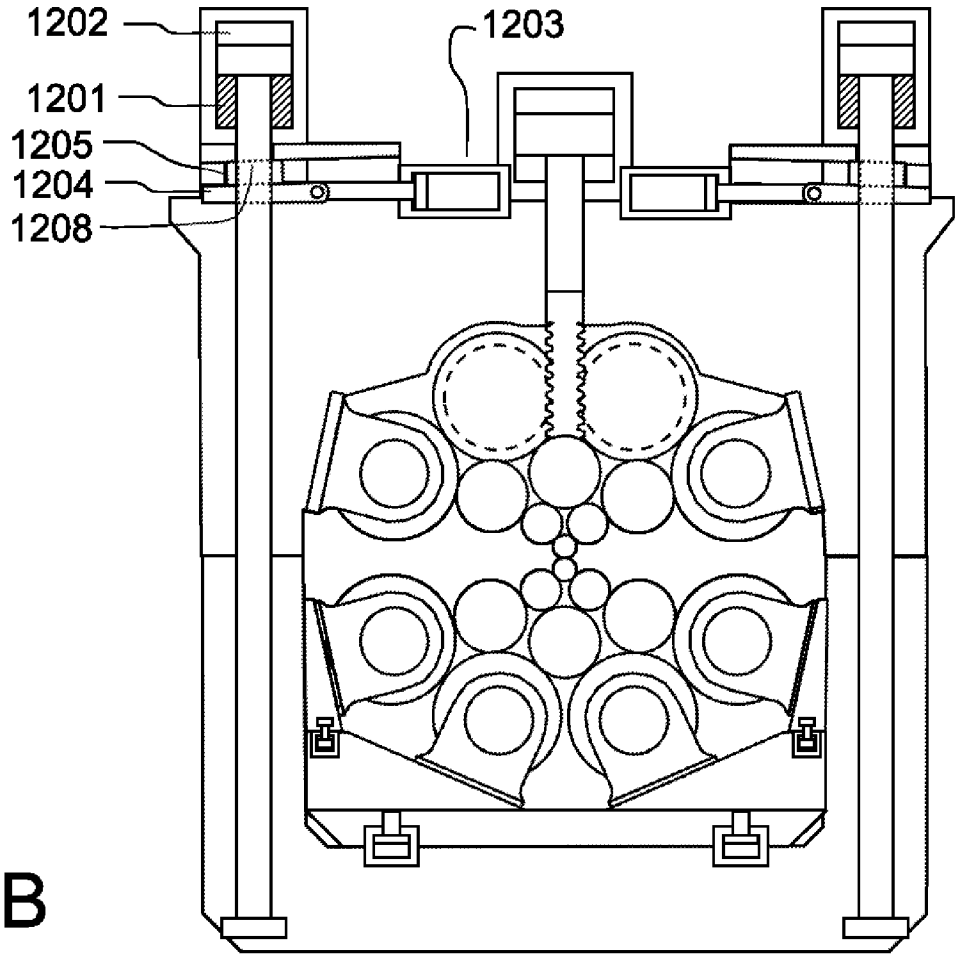
Figure 12C:
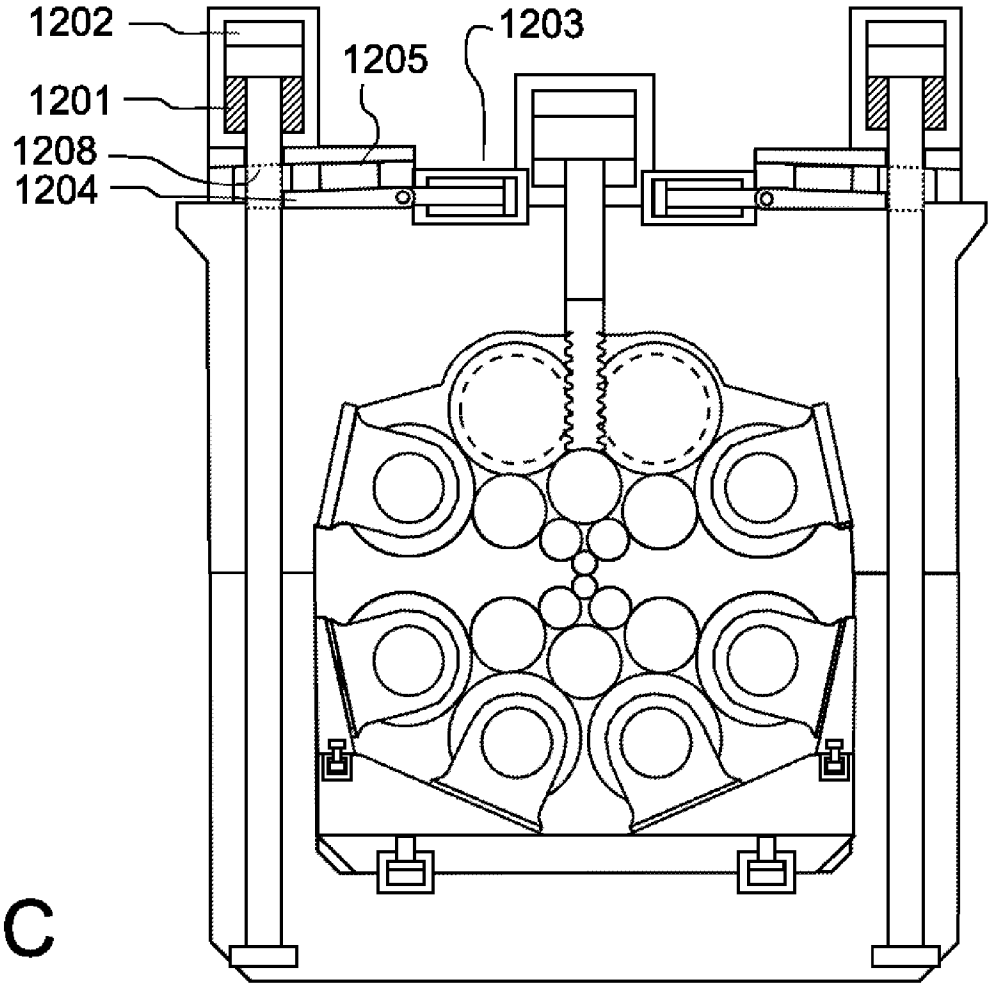

In FIG. 12B: Top pre-stress cylinder rod side 1201 is activated to high pressure Mill housings are Pre-Stressed, Small Work Rolls in mill Pre-Stress state load carried by upper prestress cylinder Tie Rod is stretched under load Upper wedges carry no load FIG. 12C: Upper wedge 1204 and filler block 1205 pulled out of tie rod.

Mill housings are Pre-Stressed, Small Work Rolls in mill

Pre-Stress state load carried by upper prestress cylinder

Tie Rod is stretched under load

Upper wedges carry no load

Figure 12D:
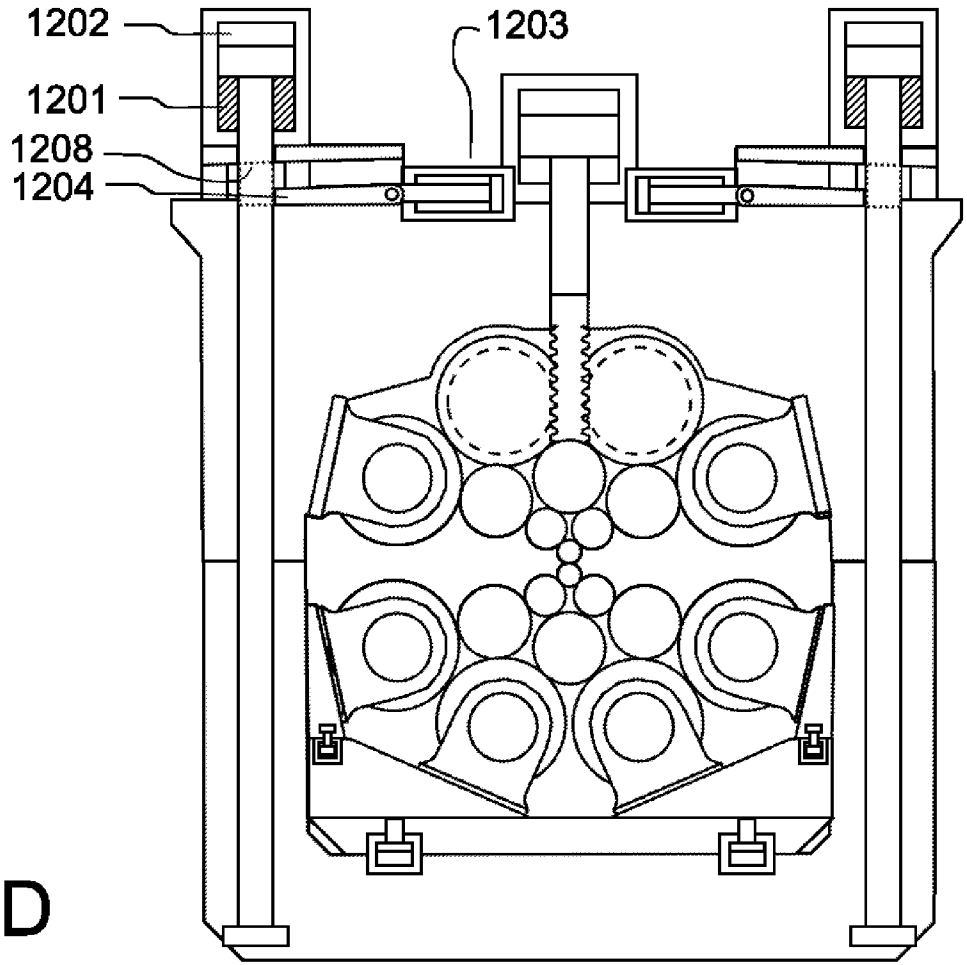

FIG. 12D: Filler block 1205 removed from upper wedge assembly

Mill housings are Pre-Stressed, Small Work Rolls in mill

Pre-Stress state load carried by upper prestress cylinder

Tie Rod is stretched under load

Upper wedges carry no load

Figure 12E:
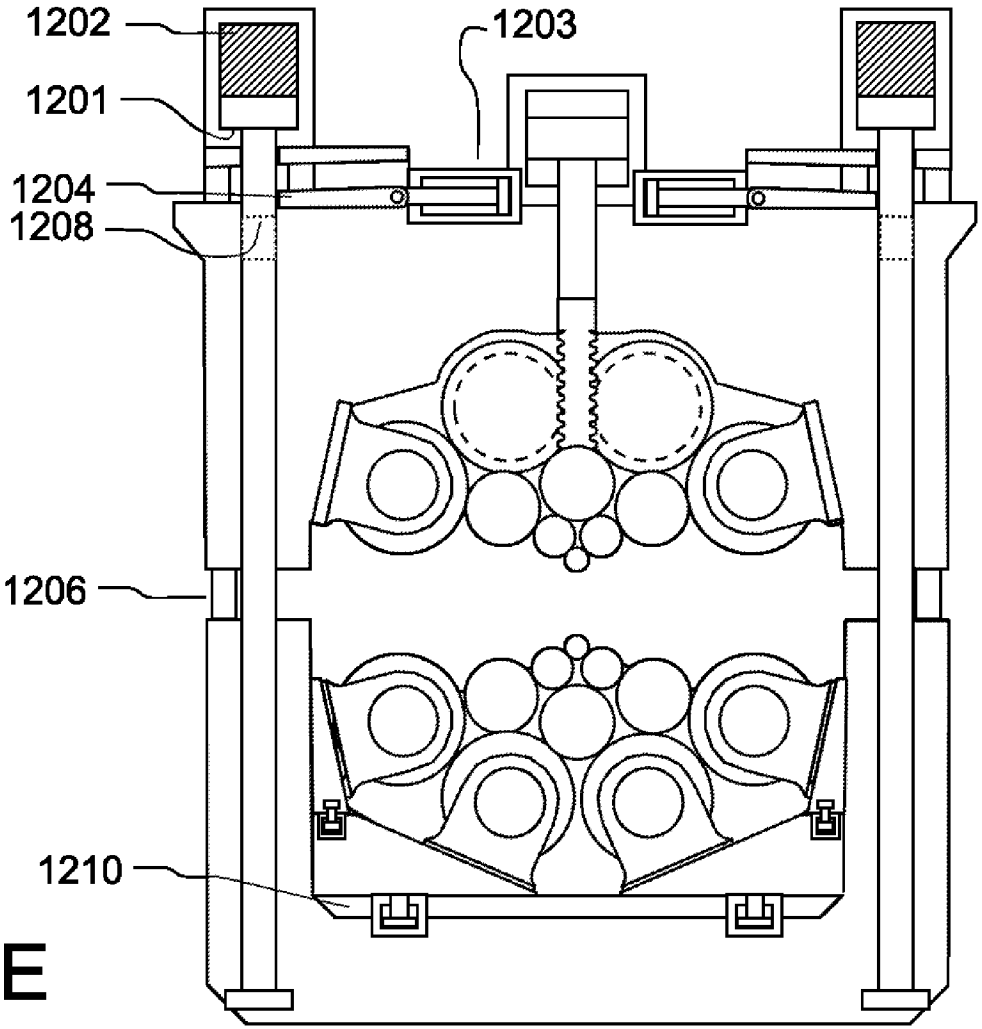

FIG. 12E: Upper prestress cylinder piston side pressurized 1201, Lower Passline Wedge 1210, Manually Insert Housing Spacer for Safety 1206

Mill housings unstressed

Mill fully opened: Small Work Rolls remain in mill

Tie Rod compressed somewhat based on weight and hydraulic pressure

No load on Top Wedge

Figure 12F:
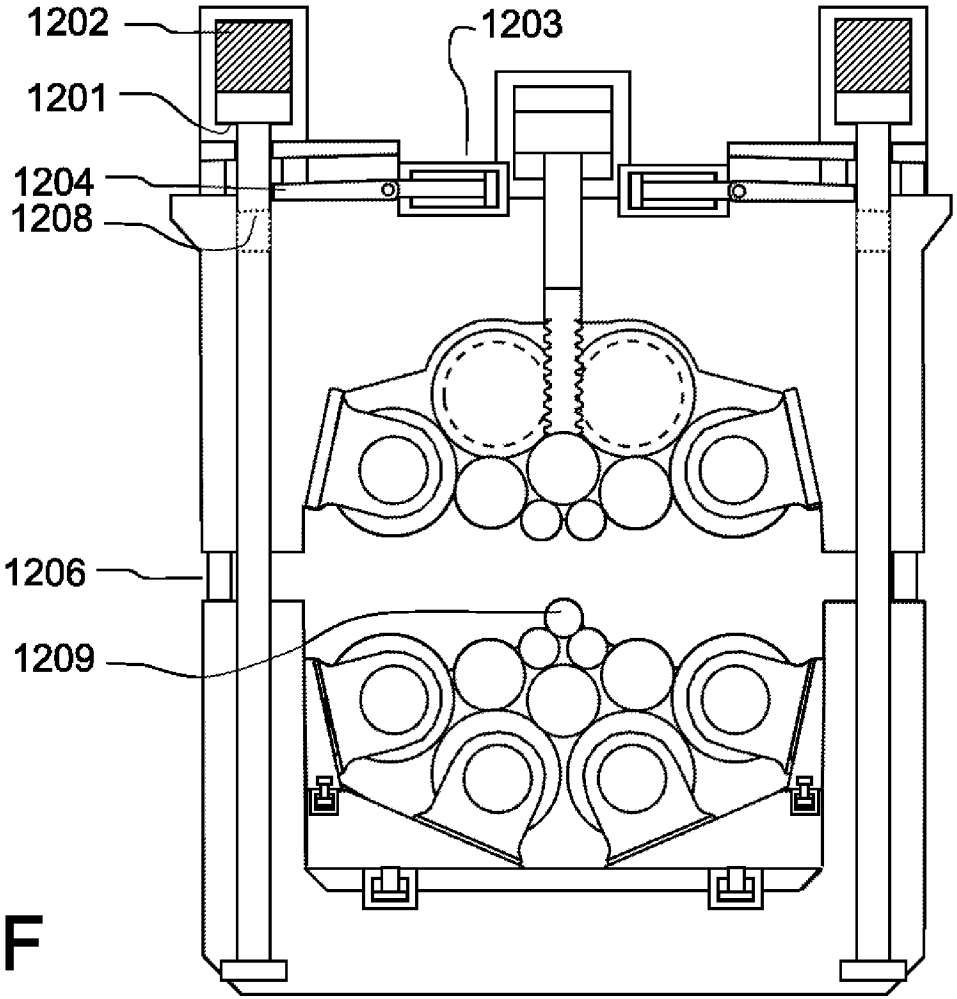

FIG. 12F: Small Work Rolls Removed, Larger Bottom Work Roll Inserted 1209

Mill housings unstressed

Mill fully opened: One Large Work Roll remain in mill

Tie Rod compressed somewhat based on weight and hydraulic pressure

No load on Top Wedge

Figure 12G:
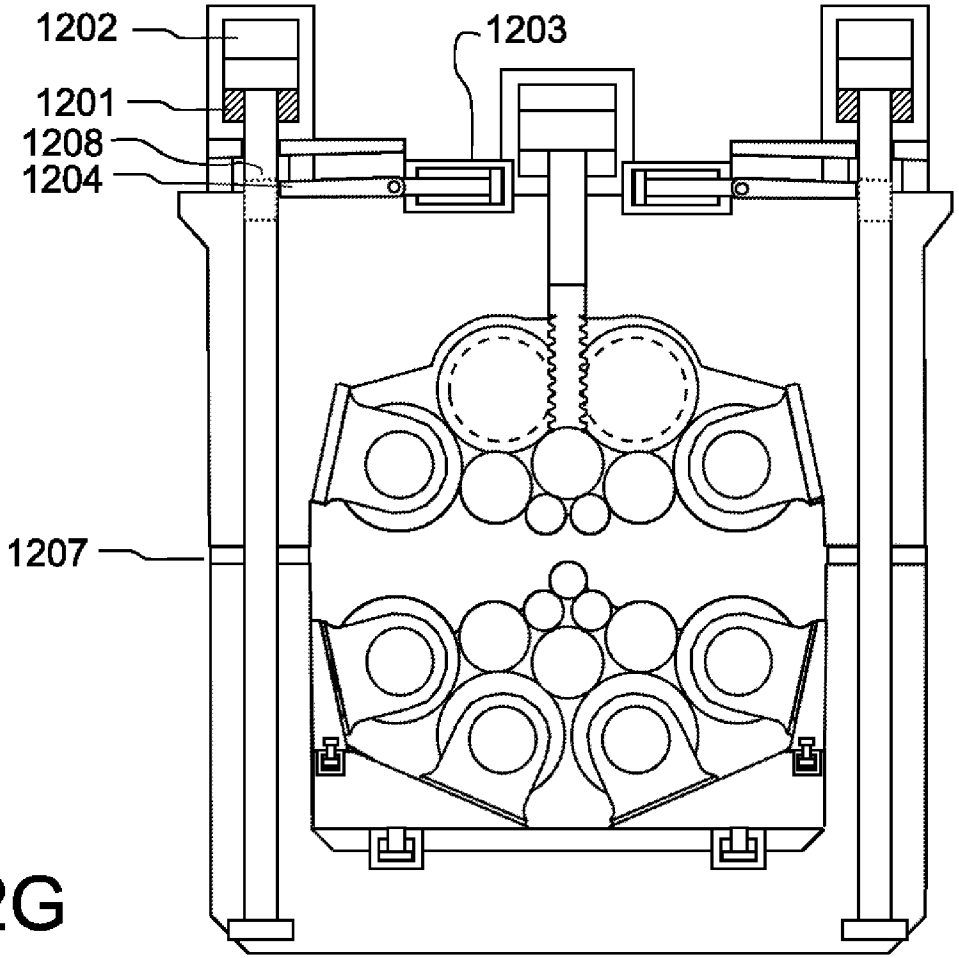
Figure 12H:
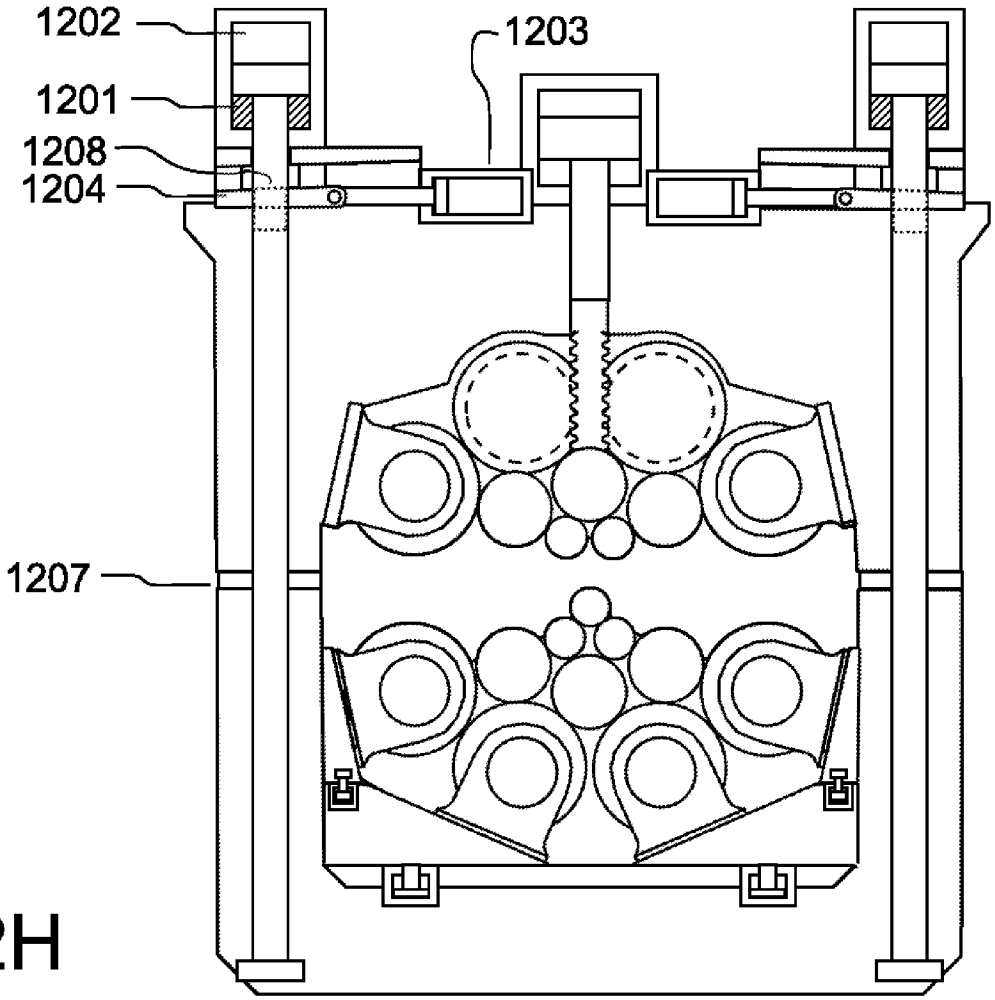
Figure 12I:
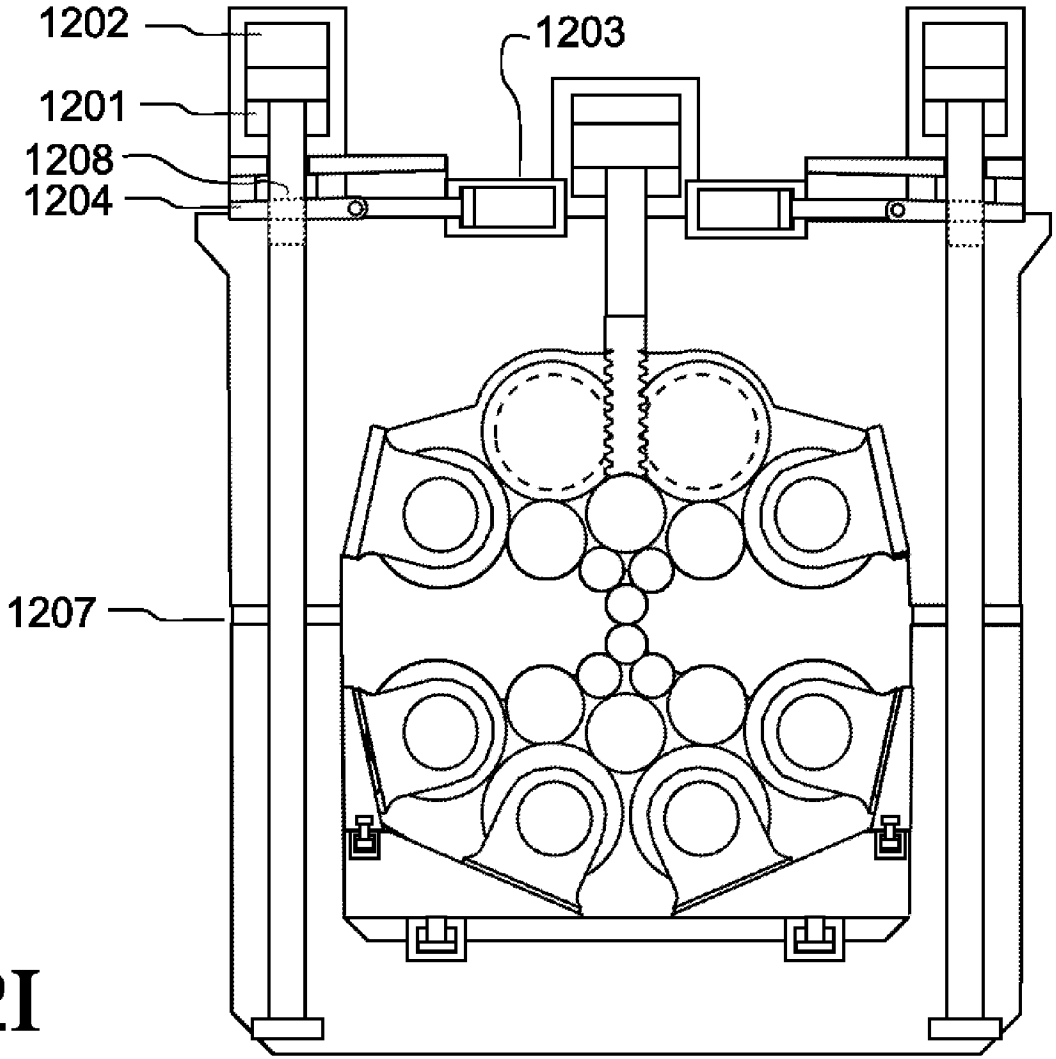

FIG. 12G: Remove Housing Spacer 1206, Insert housing spacer plate 1207, Close the mill, Top pre-stress cylinder rod side 1201 is activated to high pressure Mill housings are Pre-Stressed, Large Work Roll in mill Pre-Stress state load carried by upper prestress cylinder
Tie Rod is stretched under load
Upper wedges carry no load FIG. 12H: Activate upper wedge cylinder 1203 to insert upper wedge 1204 into Tie Rod Mill housings are Pre-Stressed, Large Work Roll in mill
Pre-Stress state load carried by upper prestress cylinder
Tie Rod is stretched under load
Upper wedges carry no load FIG. 12I: High pressure is removed from Top pre-stress cylinder rod side 1201. Place second larger top Work Roll to the mill and activate the WR holding fingers (not shown)

Mill housings are Pre-Stressed, Large Work Rolls in use
Pre-stress state load carried by Upper Wedges
Tie Rod is Stretched under load
Pre-Stress Cylinder, Rod Side Pressure is low or zero
Rolling operation is ready In the case of the present invention, the hydraulic fluid in the prestress cylinder does not cause a significant lowering of the mill stiffness when compared to a mono block.

The present invention offers important cost improvements in operation and initial capital expense by providing rolling capabilities for cold rolling and temper rolling in one design, providing a simplified gauge control system in a split housing configuration, providing a high mill stiffness, and providing important improvements in a rolling operation.

While various embodiments of the present invention have been described, the invention may be modified and adapted to various operational methods to those skilled in the art. Therefore, this invention is not limited to the description and figure shown herein, and includes all such embodiments, changes, and modifications that are encompassed by the scope of the claims.

We claim:

1. A cluster mill housing assembly comprising:

a) an upper housing, wherein said upper housing has a cavity to receive a plurality of upper rolls for a rolling operation, b) a lower housing, wherein said lower housing has a cavity to receive a plurality of lower rolls for said rolling operation, c) wherein said rolling operation reduces an entry gauge of a flat metal strip to an exit gauge, d) at least four vertical prestress rods placed substantially symmetrically with respect to a rolling force created during said rolling operation, e) wherein said upper housing moves vertically with respect to said lower housing by use of said vertical prestress rods, f) wherein said vertical prestress rods are rigidly attached to either said lower housing or said upper housing, g) a prestress hydraulic cylinder attached to each said vertical prestress rod, h) a rod wedge system for each said vertical prestress rod, i) wherein said prestress hydraulic cylinders are used to create a tensile load in said vertical prestress rods to allow engagement of said rod wedge system, j) wherein all said rod wedge systems are used to maintain said vertical prestress rods under a tension load at least large enough to create a compression stress in both said upper housing and said lower housing during said rolling operation, k) a lower roll lifter and associated lower step wedge of varying thickness used for passline control, l) at least one housing spacer plate, wherein said housing spacer plate is inserted between said upper housing and said lower housing during said rolling operation as needed for positioning said upper housing during said rolling operation, m) wherein said exit gauge is controlled by eccentric bearings, o) wherein said vertical prestress rod incorporates an opening for a rod wedge, and p) wherein said rod wedge system incorporates a machined assembly to guide said rod wedge in and out of said vertical prestress rod, and q) wherein said rod wedge either i) incorporates a spacer block to be used as needed, or ii) is a step plate, whereby said cluster mill housing assembly is useful for said rolling operation.

2. The cluster mill housing assembly according to claim 1 wherein a hydraulic cylinder assembly vertically adjusts a backup roll position across said backup roll width within said lower rolls for use in crown control to adjust said flat metal strip shape during said rolling operation.

3. The cluster mill housing assembly according to claim 2 wherein said hydraulic cylinder assembly provides bi-directional control, and said vertical adjustment of said backup roll is guided by grooves.

4. The cluster mill housing assembly according to claim 1 wherein said lower roll lifter incorporates vertical grooves on said lower housing sides.

5. The cluster mill housing assembly according to claim 1 wherein said rod wedge is shifted inside said vertical prestress rod during said rolling operation.

6. The method of rolling a flat metal strip by use of a cluster mill housing assembly comprising:

a) providing an upper housing, wherein said upper housing has a cavity to receive a plurality of upper rolls for a rolling operation, b) providing a lower housing, wherein said lower housing has a cavity to receive a plurality of lower rolls for said rolling operation, c) wherein said rolling operation reduces an entry gauge of a flat metal strip to an exit gauge, d) providing at least four vertical prestress rods that are placed substantially symmetrically with respect to a rolling force created during said rolling operation, e) wherein said upper housing moves vertically with respect to said lower housing by use of said vertical prestress rods, f) wherein said vertical prestress rods are rigidly attached to either said lower housing or said upper housing, g) providing a prestress hydraulic cylinder attached to each said vertical prestress rod, h) providing a rod wedge system for each said vertical prestress rod, i) wherein said prestress hydraulic cylinders are used to create a tensile load in said vertical prestress rods to allow engagement of said rod wedge system, j) wherein all said rod wedge systems are used to maintain said vertical prestress rods under a tension load at least large enough to create a compression stress in both said upper housing and said lower housing during said rolling operation, k) providing a lower roll lifter and associated lower step wedge of varying thickness that are used for passline control, l) providing at least one housing spacer plate, wherein said housing spacer plate is inserted between said upper housing and said lower housing during said rolling operation as needed for positioning said upper housing during said rolling operation, m) using said cluster mill housing assembly in said rolling operation, wherein said exit gauge is controlled by eccentric bearings, o) wherein said vertical prestress rod incorporates an opening for a rod wedge, and p) wherein said rod wedge system incorporates a machined assembly to guide said rod wedge in and out of said vertical prestress rod, and q) wherein said rod wedge either i) incorporates a spacer block to be used as needed, or ii) is a step plate.

7. The cluster mill housing assembly according to claim 6 wherein said rod wedge is shifted inside said vertical prestress rod during said rolling operation.

* * * * *